US006511515B1

(12) United States Patent
Arnott et al.

(10) Patent No.: US 6,511,515 B1
(45) Date of Patent: Jan. 28, 2003

(54) ROLLER SHADE TREATMENT AND METHOD

(75) Inventors: Robert C. Arnott, Spartanburg, SC (US); J. Phillip Gold, Greenville, SC (US)

(73) Assignee: Milliken & Company, Spartanburg, SC (US)

( * ) Notice: Subject to any disclaimer, the term of this patent is extended or adjusted under 35 U.S.C. 154(b) by 266 days.

(21) Appl. No.: 09/615,506

(22) Filed: Jul. 13, 2000

(51) Int. Cl.[7] ..... D06M 0/00; D06M 13/00; C01B 25/01; C01B 31/32; C01B 7/01

(52) U.S. Cl. ..... 8/115.51; 8/115.6; 8/116.1; 428/323; 428/441; 428/482; 428/500

(58) Field of Search ..... 428/323, 482, 428/441, 500; 8/115.51, 115.6, 116.1

(56) References Cited

U.S. PATENT DOCUMENTS

| | | | | |
|---|---|---|---|---|
| 4,276,212 A | 6/1981 | Khanna et al. | ..... | 260/39 R |
| 4,396,672 A | 8/1983 | Adesko | ..... | 428/323 |
| 4,645,704 A | 2/1987 | Hellwig | ..... | 428/176 |
| 5,721,309 A | 2/1998 | Sharma et al. | ..... | 524/506 |

FOREIGN PATENT DOCUMENTS

| | | |
|---|---|---|
| AU | 41374/93 | 6/1993 |
| EP | 0 040 329 | 11/1981 |
| EP | 0 955 404 | 11/1999 |
| GB | 1 578 071 | 2/1977 |
| NL | 9100429 | 10/1992 |

*Primary Examiner*—Yogendra N. Gupta
*Assistant Examiner*—D G Hamlin
(74) *Attorney, Agent, or Firm*—Terry T. Moyer; Thomas L. Moses

(57) ABSTRACT

A roller shade material, such as 100% polyester, is passed through a bath, so that both sides of the material are coated by the bath. In a preferred embodiment, the bath includes an acrylic polymer finish, and a melamine-formaldehyde cross-linking agent. The acrylic polymer preferably is approximately 45% solid, and comprises about 47% to 48% of the bath by weight. The cross-linking agent preferably comprises about 2.5% of the bath by weight, and is about 80% solid material. The bath should have a pH in the basic range between about 7 and 9.5, and the preferred base used to adjust the pH is N,N-Diethylethanolamine. Optional compounds that may be added to the bath include an anti-stick compound and a defoaming agent. This treatment produces a roller shade having a clear coating that allows the color, texture and weave of the substrate to show, without hindering the ability of light to pass through the material. Further, and more importantly, the coating provides dimensional stability for the roller shade, which reduces or eliminates the tendency of the material to distort by bowing, cupping, or cambering, and preserves the hand and feel of the product.

10 Claims, No Drawings

ROLLER SHADE TREATMENT AND METHOD

BACKGROUND OF THE INVENTION

1. Field of the Invention

The present invention is related to a method of treating roller shades to provide superior hanging characteristics. More specifically, the roller shade material is padded in a bath containing an acrylic polymer finish and a cross-linking resin in a basic mixture, so that the weight of the dried coating comprises between 18% and 40% of the total dry weight of the coated material.

One problem that has been traditionally associated with roller shades is the tendency for the material to distort when the shade is in the unrolled, extended position. Often, the material has a tendency to cup or bow, which means the shade is configured in a mild C shape, in one direction or the other. Another distortion characteristic of the material is the tendency for the material to torque or camber, which means that the do shade tends to twist either in a clockwise or counter-clockwise direction with respect to the top edge of the shade.

Several attempts have been made to overcome these problems. One approach has been to use heavy gauge fabric that has fewer tendencies to distort. The drawback to this approach is that it is sometimes desirable to provide a lighter gauge fabric for roller shades, particularly in cases where it is desirable to allow some light to pass through the shade. Another proposed solution has been to attach a heavy base rod or other base member to the bottom edge of the roller shade to prevent the distortion, which has met with limited success. While this approach prevents the bottom edge from cupping or bowing, the sides of the material still tend to distort, and the base member does not prevent, or even reduce, the tendency for the material to camber. Yet another proposed solution to the distortion problem is to coat the material with a heavy layer of polymeric material, which destroys the hand and feel of the product.

Therefore, it would be desirable to provide a coating for roller shades that prevents or minimizes distortion tendencies, and which does not negatively affect the hand and feel of the product. Further, it would be desirable to provide a method for treating roller shades that may be performed with minimal steps, and also which is inexpensive to implement and run. Moreover, it would be desirable to provide a roller shade having a clear coating that provides dimensional stability for the material, without limiting the transmission of light through the product.

2. Description of the Prior Art

All patents cited are incorporated herein by reference in their entirety. The following patents are generally directed to polymeric coatings for various substrates.

U.S. Pat. No. 4,276,212, issued to Khanna, et al., teaches a high solids coating composition containing at least 50% by weight of a binder of film-forming constituents in which the constituents are of:

(a) an acrylic polymer that has a number average molecular weight of about 500–4,500, a hydroxyl content of at least 2% by weight, a glass transition temperature of about −20° C. to 20° C., and optionally contains a chain transfer agent, and is of an alkyl methacrylate, a hydroxy alkyl acrylate or a hydroxy alkyl methacrylate, and optionally, an alkyl acrylate or styrene (b) an alkylated melamine formaldehyde cross-linking agent; the composition is particularly useful as an exterior finish for automobiles, trucks, airplanes and can be used as an appliance finish and for coil coatings.

U.S. Pat. No. 4,396,672, issued to Adesko, is directed to a substrate having a cured color coat layer of a pigmented coating composition and a cured clear coat layer firmly adhered to the color coat layer; wherein the layers are formed from a high solids coating composition containing at least 40% by weight of a binder of film-forming constituents in which the constituents are of:

(1) an acrylic polymer of styrene or methyl methacrylate or mixtures thereof, an alkyl acrylate or an alkyl methacrylate and a hydroxyl alkyl acrylate or methacrylate, (2) a polyester polyol, and (3) an alkylated melamine formaldehyde cross-linking agent and optionally, an acid catalyst; the clear coat/color coat finish is particularly useful as an exterior finish for automobiles, trucks, and airplanes.

U.S. Pat. No. 5,721,309, issued to Sharma, et al., teaches a water based coating composition that provides a stain resistant layer which adheres well to a substrate and is resistant to chemical attack by common household cleaning solvents such as isopropyl alcohol. The coating composition is aqueous based and incorporates a cross-linkable acrylic polymer latex, an amino resin cross-linking agent and a cross-linking catalyst. The polymer, cross-linking agent and catalyst are dispersed and/or solubilized in an aqueous medium. The coating composition is particularly well suited for application to flexible vinyl chloride polymer substrates to produce upon curing and drying a stain resistant, easily cleanable laminate.

None of the prior art, however, teaches a treatment for roller shades, comprising a bath including an acrylic polymer finish and a cross-linking resin in a basic medium without a catalyst, where the roller shade material is padded through the bath, and where the final dry weight of the coating comprises 18% to 40% of the dry weight of the coated material.

OBJECTS OF THE INVENTION

Accordingly, an important object of the present invention is to provide a roller shade treatment that provides dimensional stability and reduces or eliminates the tendency for the roller shade material to distort while hanging in an unrolled, extended position.

Another important object of the present invention is to provide a clear coating for a roller shade that allows the color, texture and weave of the substrate to show, without hindering the ability of light to pass through the material.

Yet another important object of the present invention is to provide a roller shade treatment that is durable and allows the roller shade to be either spot cleaned or cleaned by immersion in soap and water.

Still another important object of the present invention is to provide a roller shade having acceptable hand and feel, and which provides resistance to fraying on the edges.

Another important object of the present invention is to provide a novel roller shade produced by a treatment process that is inexpensive to implement and run, and which overcomes some of the problems associated with prior art roller shades and processes for treating them.

These and other features, aspects, and advantages of the present invention will become better understood with reference to the following description and appended claims.

DETAILED DESCRIPTION OF THE PREFERRED EMBODIMENT

In a preferred embodiment, a roller shade material, such as 100% polyester, is passed through a bath, so that both sides of the material are coated by the bath. The bath includes an acrylic polymer finish, which is sold commercially under the trade name POLYCRYL 7F7 by Rohm & Haas, and an alkylated melamine—formaldehyde cross-linking agent commercially available from B.F. Goodrich under the trade name AEROTEX M3. The acrylic polymer emulsion is preferably approximately 45% solid, and comprises about 40%–55% of the bath, and preferably 47% to 48% of the bath. The AEROTEX cross-linking agent comprises about 80% solids as received, and makes to up approximately 1%–5% of the bath, and preferably comprises 2.5%–3.5% of the bath. The bath has a pH in the basic range of about 7 to 9, and the preferred base used to adjust the pH is N,N-Diethylethanolamine, commercially sold by BASF.

Optional compounds that may be added to the bath include an anti-stick compound, used to prevent fabric from sticking to the pins or the tenter frame during the drying and curing step. The preferred anti-stick compound is emulsified lubricant, sold under the trade name ANTISTICK N, by Relco Chemical Co. Defoamers may be used as well, including DEFOAMER 908 from Milliken Chemical.

It is to be understood, however, that many permissible variations may be made in the bath composition. For example, although the cross-linking agent has been described as a melamine-formaldehyde resin, it should be noted that any suitable cross-linking agent may be used. Also, other polymers may be used in lieu of acrylic, including styrene/acrylic, polyurethane, polyvinyl acetate, and polyvinyl chloride. Ammonia, or other bases, may be substituted for the N,N-Diethylethanolamine.

In the manufacturing process, the roller shade material, which is preferably of a weight ranging from approximately 1.8 oz/yd$^2$ to 8 oz/yd$^2$, is padded through the bath. Then the material is nipped through a pair of rollers to squeeze the excess liquid from the fabric. The material is then dried and cured, preferably using a tenter frame, at a drying temperature of about 385° F. The drying and curing steps strengthen the dimensional stability of the fabric when polyester fabric is used, because the polyester fabric is heat set. The dry add-on or coating ultimately comprises between 18% and 40% of the weight of the dry coated fabric. In a most preferred embodiment, the dry add-on coating comprises between 20% and 25% of the weight of the dry coated fabric.

In the following Example, a comparative test was performed on a product manufactured in accordance with the preferred embodiment of the present invention, and was also performed on other, similar products currently available in the marketplace. The test, hereinafter referred to as the Heat Chamber test, was performed to measure the distortion characteristics of a variety of roller shades. The purpose of the test was to simulate the high temperatures that may occur in a closed up dwelling or motor home, that may contain a roller shade, and measure the effect of the heat on the performance and hanging characteristics of the roller shade material.

EXAMPLE 1

Table 1 shows the results of a distortion comparison test between the Milliken products, manufactured in accordance with the present invention, and competing products manufactured by Montreal Woolens.

TABLE 1

| | Milliken: Satin | Montreal Woolens: Jacquard | Montreal Woolens: Dobbie | Milliken: Silk Slub |
|---|---|---|---|---|
| Ends/Inch | 61 | 101 | 49 | 149 |
| Picks/Inch | 62 | 40 | 49 | 63 |
| Weight (oz/yd$^2$) | 2.86 | 6.21 | 5.54 | 4.70 |
| Blend | 100% polyester | 100% polyester | 100% polyester | 100% polyester |
| Warp Yarn | 1/180/34 | 200 | 600 | n/a |
| Fill Yarn | 1/150/34 | 400 | 400 | n/a |
| Selvedge Type | Fringe | Tuck | Tuck | n/a |
| Distortion (inches) | 0 | 5/8 | 1/4 | 1/16 |
| Handleometer measurements (Warp/Fill) | 186/75 | 829/>1000 | 673/710 | 207/645 |

The test was run by placing 12 inch by 12 inch square samples of each fabric, hung with the warp direction running vertically, in an oven at a temperature of 170° F. for 4 hours in the extended position. Then, the roller shade fabrics were removed from the oven and hung and measured. A straight ruler was placed against both sides of the roller shade, establishing a plane. A measurement was taken to determine the farthest distance between the plane and a corresponding point on the fabric. Higher distance measurements indicate higher levels of distortion for the roller shade fabrics, and conversely, lower distance measurements indicate lower, more desirable, levels of distortion. These measurements were provided for bowed, cupped, or cambered roller shades.

The handleometer test was conducted by using blade to push a 4 inch by 4 inch sample of each material downwardly into a 10 mm slot. The test measured the number of grams necessary to bend the fabric and push the sample to a specific depth into the slot. This test was performed to measure the force necessary to bend the fabric in the warp direction and in the fill direction.

It can be seen from Table 1 that the coating provides dimensional stability that cannot be produced by competitive products in the art. Further, no other treatments for roller shade material provide proper hanging properties in combination with acceptable handleometer numbers within the ranges of 185–650 in the warp direction, and 75–650 in the fill direction.

Although the present invention has been described in considerable detail with reference to certain preferred versions thereof, other versions are possible. Therefore, the spirit and scope of the appended claims should not be limited to the description of the preferred versions contained herein. All features disclosed in this specification may be replaced by alternative features serving the same, equivalent or similar purpose, unless expressly stated otherwise. Thus, unless expressly stated otherwise, each feature disclosed is one example only of a generic series of equivalent or similar features.

What is claimed is:

1. A method for applying a finish coating to a roller shade material, said method comprising the steps of:

providing a bath having an acrylic polymer, an anti-stick compound and a cross linking agent in a mixture having a pH above 7.0;

applying said bath to a roller shade material through a padding process so that the dry weight of the coating ultimately falls between the range of 18% to 40% of the total weight of the coated substrate; and drying said substrate.

2. The method set forth in claim 1, wherein said acrylic polymer is Polycryl 7F7.

3. A roller shade treated in accordance with the method set forth in claim 2.

4. The method set forth in claim 1, wherein said cross-linking agent is Aerotex M3.

5. A roller shade treated in accordance with the method set forth in claim 4.

6. The method set forth in claim 1, wherein said bath further includes N,N-Diethylethanolamine.

7. A roller shade treated in accordance with the method set forth in claim 6.

8. The method set forth in claim 1, wherein the dry weight of the coating ultimately falls between the range of 20% to 25% of the total weight of the coated substrate.

9. A roller shade treated in accordance with the method set forth in claim 8.

10. A roller shade treated in accordance with the method set forth in claim 1.

* * * * *